United States Patent [19]

Narita et al.

[11] Patent Number: 4,773,380

[45] Date of Patent: Sep. 27, 1988

[54] CURRENT FLOWING TIME PERIOD CONTROL SYSTEM FOR IGNITION COIL OF INTERNAL COMBUSTION ENGINE

[75] Inventors: Ko Narita, Aichi; Koichi Toyama, Kariya; Takeshi Matsui, Toyohashi, all of Japan

[73] Assignee: Nippondenso Co., Ltd., Kariya, Japan

[21] Appl. No.: 869

[22] Filed: Jan. 6, 1987

[30] Foreign Application Priority Data

Jan. 9, 1986 [JP] Japan ..... 61-2823

[51] Int. Cl.[4] ..... F02P 3/045; F02P 3/05

[52] U.S. Cl. ..... 123/609; 123/416; 123/427; 123/644

[58] Field of Search ..... 123/415, 416, 417, 427, 123/609, 610, 611, 644, 651

[56] References Cited

U.S. PATENT DOCUMENTS

| | | | |
|---|---|---|---|
| 4,081,995 | 4/1978 | Griffith et al. | 123/416 X |
| 4,174,696 | 11/1979 | Jundt et al. . | |
| 4,176,645 | 12/1979 | Jundt et al. | 123/644 |
| 4,198,936 | 4/1980 | Pagel et al. | 123/609 |
| 4,253,443 | 3/1981 | Seeger et al. | 123/609 |
| 4,378,778 | 4/1983 | Harter | 123/644 X |

*Primary Examiner*—Tony M. Argenbright

*Attorney, Agent, or Firm*—Cushman, Darby & Cushman

[57] ABSTRACT

A current flowing time period control system for an ignition coil of an internal combustion engine is disclosed in which a current flowing time period setting circuit sets the time period for supplying the primary current of the ignition coil and an output signal of the current flowing time period setting circuit is amplified by a drive circuit and supplied to a power transistor, whereby the primary current of the ignition coil is intermittented to control the ignition operation. The current flowing time period control system has a primary current rise detection circuit for detecting the rise period of the primary current of the ignition coil to 1/n of the desired interruption current value (n>1), and includes an accumulation device in which the accumulated amount changes gradually in one direction at a first rate until detection of the rise of the ignition coil primary current to 1/n of the desired interruption current value by the rise detection circuit, in the other direction at a second rate gradually at an ignition timing, and again in the original direction at a third rate 1/n of the first rate. In accordance with the accumulated amount of the accumulation device, a time length n times longer than the time period required for the rise of the ignition coil primary current to 1/n of the desired interruption current value is set as a primary current flowing time period for the next ignition cycle.

5 Claims, 4 Drawing Sheets

CURRENT FLOWING TIME PERIOD CONTROL SYSTEM FOR IGNITION COIL OF INTERNAL COMBUSTION ENGINEcBACKGROUND OF THE INVENTION

1. Field of the Invention

This invention relates to a system for controlling the current flowing time length of the ignition coil of an ignition system for an internal combustion engine.

2. Description of the Related Art

In a conventional current flowing time period control system for an ignition coil of the ignition system for an internal combustion engine, in order to control a current value for interrupting the primary current of the ignition coil (hereinafter referred to as "the interruption current value") to be a target level, the difference between the time length required for reaching a target interruption current value and an actual current flowing time period is detected on the basis of the time length required before the primary current value reaches 1/n of the target interruption current value, and the next ignition cycle is compensated for the particular time difference thereby to set the flowing time period of the primary current (as disclosed in U.S. Pat. No. 4,174,696).

The aformementioned conventional system, however, requires two types of counters. One is a compensating up-down counter for detecting the difference between the time period required before the target interruption current value is reached and the actual current flowing time period, and another is a counter for setting a current flowing time period for the next ignition cycle. Furthermore, the conventional system requires a data transfer circuit therebetween. Thus, the conventional system results in a very bulky circuit configuration.

SUMMARY OF THE INVENTION

The object of the present invention is to provide a current flowing time period control system for an ignition coil of an internal combustion engine, which is simple in construction and greatly reduced in the size of the circuit configuration.

According to the present invention, there is provided a current flowing time period control system for an ignition coil of an internal combustion engine, comprising a power transistor for turning on and off the primary current of the ignition coil, a primary current rise detection circuit for detecting the rise of the primary current of the ignition coil to a level 1/n of the desired interruption current value ($n>1$), a current flowing time period setting circuit including accumulation means in which the accumulated amount changes in one direction at a first rate until the rise of the primary current of the ignition coil to 1/n of the desired interruption current value is detected by the rise detection circuit, changes in the other direction at a second rate gradually at the ignition timing, and changes again in the original direction at a third rate which is 1/n of the first rate, wherein the time n times longer than the rise time of the primary current of the ignition coil to 1/n of the desired interruption current value is set as the primary current flowing time period for the next ignition cycle in accordance with the accumulated amount of the accumulation means, and a drive circuit for driving the power transistor in accordance with the primary current flowing time period set by the current flowing time period setting circuit.

In this system, single accumulation means is used to change the accumulated amount in one direction at a first rate until the rise of the primary current to 1/n of the desired interruption current value, and after the accumulated amount is changed in the other direction at a second rate gradually at the ignition timing, change the accumulated amount again in the original direction at a third rate equal to 1/n of the first rate, so that the time n times longer than the rise time of the primary current of the ignition coil to 1/n of the desired interruption current value is set as the primary current flowing time period for the next ignition cycle in accordance with the change in the accumulated amount.

According to the present invention, single accumulation means is used to change the accumulated amount thereof in one direction at a first rate gradually until the rise of the primary current to 1/n of the desired interruption current value, and after changing the accumulated amount gradually in the other direction at a second rate at a subsequent ignition timing, change the accumulated amount again in the original direction at a third rate 1/n of the first rate. In accordance with these changes in the accumulated amount, the time length n times longer than the time length required for rising of the primary current of the ignition coil to 1/n of the desired interruption current value is set as a primary current flowing time period for the next ignition cycle. As a result, a data transfer circuit required in the conventional system is eliminated, thereby achieving great advantages of a simple construction and a remarkably reduced circuit size.

DESCRIPTION OF THE PREFERRED EMBODIMENT

Figure 2:
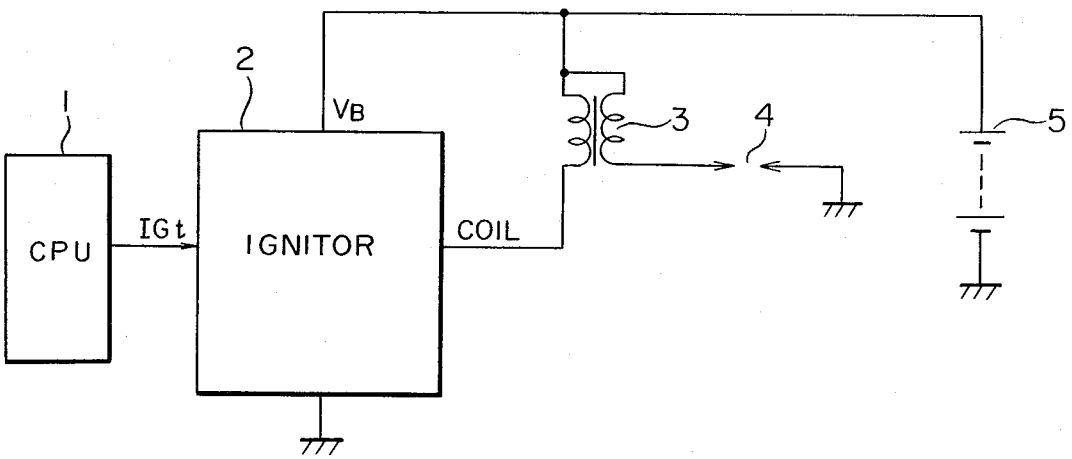
FIG. 2 is a block diagram showing an ignition system using the current flowing time period control system shown in FIG. 1.

An embodiment of the present invention will be explained below with reference to the accompanying drawings. In FIG. 2, reference numeral 1 designates a central processing unit (hereinafter referred to as "CPU") of a computer for controlling the engine, which produces an ignition signal IGt provided for an ignitor 2. This ignition signal IGt includes pulses indicating the ignition timing determined by calculations in CPU 1, which have a pulse width corresponding to a predetermined crank angle, respectively. Numeral 2 designates an ignitor for controlling the ignition operation of an ignition coil in synchronism with the ignition signal. Numeral 3 designates the ignition coil for generating a high voltage in the secondary circuit thereof by an output signal COIL from the ignitor 2. Numeral 4 designates an ignition plug in the engine, and numeral 5 a battery.

Figure 1:
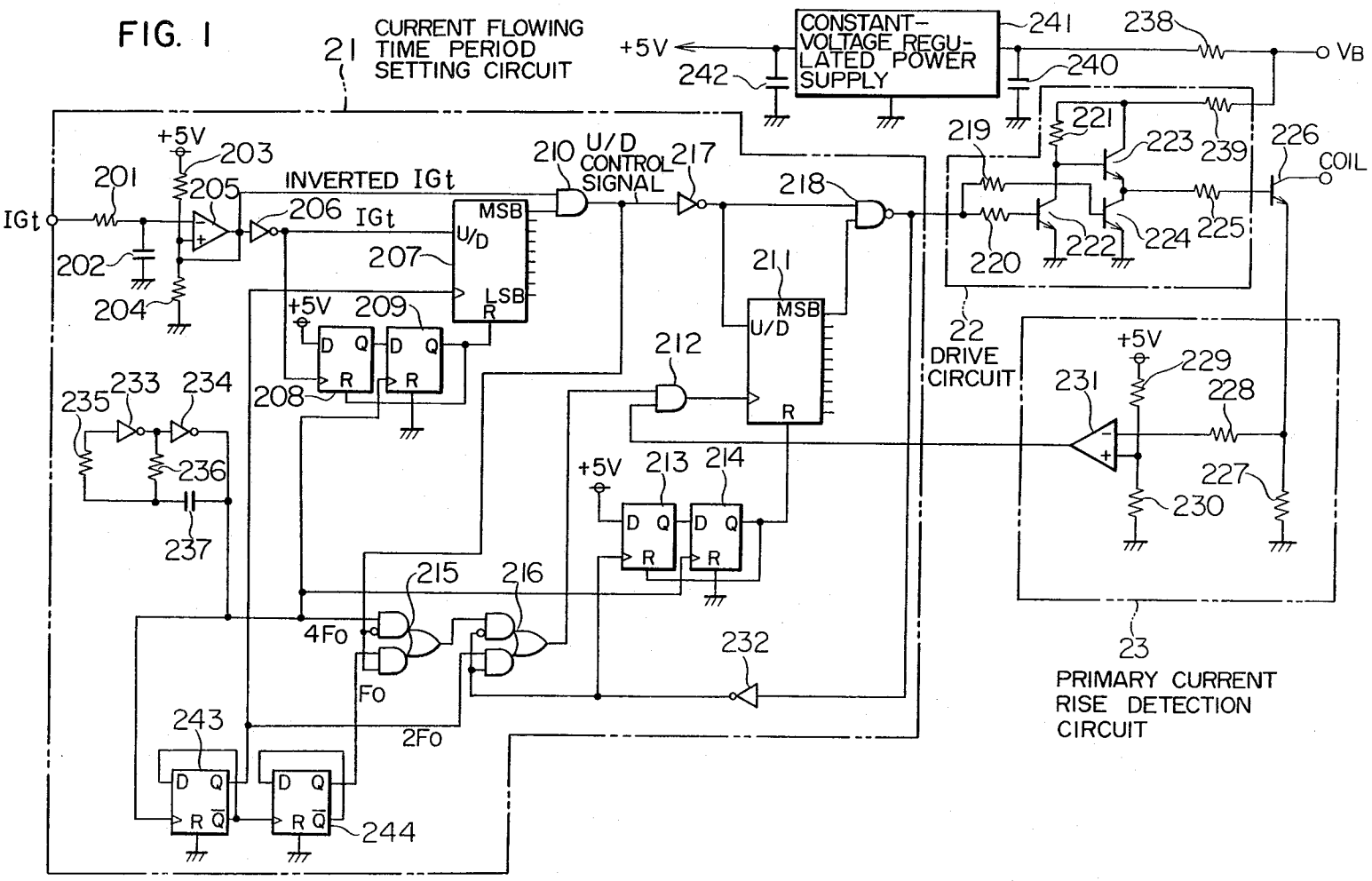
FIG. 1 is an electrical circuit diagram showing an embodiment of the current flowing time period control system according to the present invention.

The ignitor 2 is configured as shown in FIG. 1. Numeral 201 designates a resistor for removing noises of the ignition signal IGt applied from CPU 1, and numeral 202 a noise-removing capacitor. Numeral 205 designates a comparator for converting the applied ignition signal IGt to an inverted signal. The threshold level in the comparator 205 is determined by the ratio between the resistors 202 and 204. Numeral 206 designates an inverter for inverting the signal supplied from the comparator 205 and consequently producing the ignition signal IGt again. Numeral 207 designates an up-down counter which produces an up-down control signal described later for controlling the timing of the counting operation of a current flowing time period setting up-down counter 211 in the subsequent stage on the basis of the ignition signal IGt. Numerals 208 and 209 designate D-type flip-flops which have a function as a logic differentiation circuit for detecting the leading edge of the each pulse of the ignition signal IGt. Numeral 210 designates an AND circuit making up a gate for the output of the up-down counter 207. Numeral 211 designates an up-down counter for controlling the primary current flow in the ignition coil 3 by measuring the current rising time period and setting the current flowing time period in the ignition coil 3 as described later. Numeral 212 designates an AND gate making up a gate for the clock signal applied to the up-down counter 211. Numerals 213 and 214 designate D-type flip-flops, which are as same as the D-type flip-flops 208 and 209, are constructed to have a function as a logic differentiation circuit. Numerals 215 and 216 designate digital change-over switches made of logic circuit elements for switching the frequency of the clock signal applied to the up-down counter 211. Numeral 217 designates an inverter for inverting the output signal of the AND circuit 210. Numeral 218 designates a NAND circuit making up a gate for the output signal of the up-down counter 211. Numerals 219 and 220 designate resistors for limiting the base currents supplied from the NAND circuit 218 to transistors 222 and 224, respectively. Numeral 221 designates a resistor for limiting the collector current of the transistor 222. Numerals 222, 223 and 224 designate transistors for current-amplifying the inputted signals. Numeral 225 designates a resistor for limiting the base current of a power transistor 226. Numeral 226 designates the power transistor for driving the ignition coil 3. Numeral 227 designates a resistor for detecting the emitter current of the power transistor 226. Numeral 228 designates a resistor for limiting the input current of a comparator in the next stage. Numeral 231 designates the comparator for producing a pulse on the basis of the output current waveform of the power transistor 226. The comparator 231 has a threshold level determined by the ratio between the resistors 229 and 230. Numeral 232 designates an inverter for inverting the signal outputted from the NAND circuit 218. Numerals 233 and 234 designate inverters making up an oscillation circuit, and the oscillation frequency 4Fo of which is determined by resistors 235, 236 and a capacitor 237. Numerals 243 and 244 designate D-type flip-flops for frequency-dividing the frequency 4Fo of the oscillation circuit into $\frac{1}{2}$ (2Fo) and $\frac{1}{4}$ (Fo), respectively. Numerals 238 and 239 designate resistors arranged between the battery 5 and the circuit elements in the ignitor 2 in order to limit the current. Numerals 240 and 242 designate capacitors for removing noises. Numeral 241 designates a constant-voltage regulated power supply for converting the voltage of the battery 5 into a constant DC voltage of 5V. This constant DC voltage is supplied to each element in the ignitor 2 as a source voltage.

The circuit parts designated by numeral 21 surrounded by a two-dot chain in FIG. 1 make up a current flowing time period setting circuit for setting the flowing time period of the primary current in the ignition coil 3; the circuit parts designated by numeral 22 make up a drive circuit for driving the power transistor 226; and the circuit parts designated by numeral 23 make up a primary current rise detection circuit for detecting the rise state of the primary current in the ignition coil 3 to a 1/n level of the desired interruption current value. Also, the current flowing time period setting up-down counter 211 makes up accumulation means.

The operation of the system will be explained with reference to the circuit diagram of FIG. 1 and the waveform diagram of FIG. 3.

Figure 3:
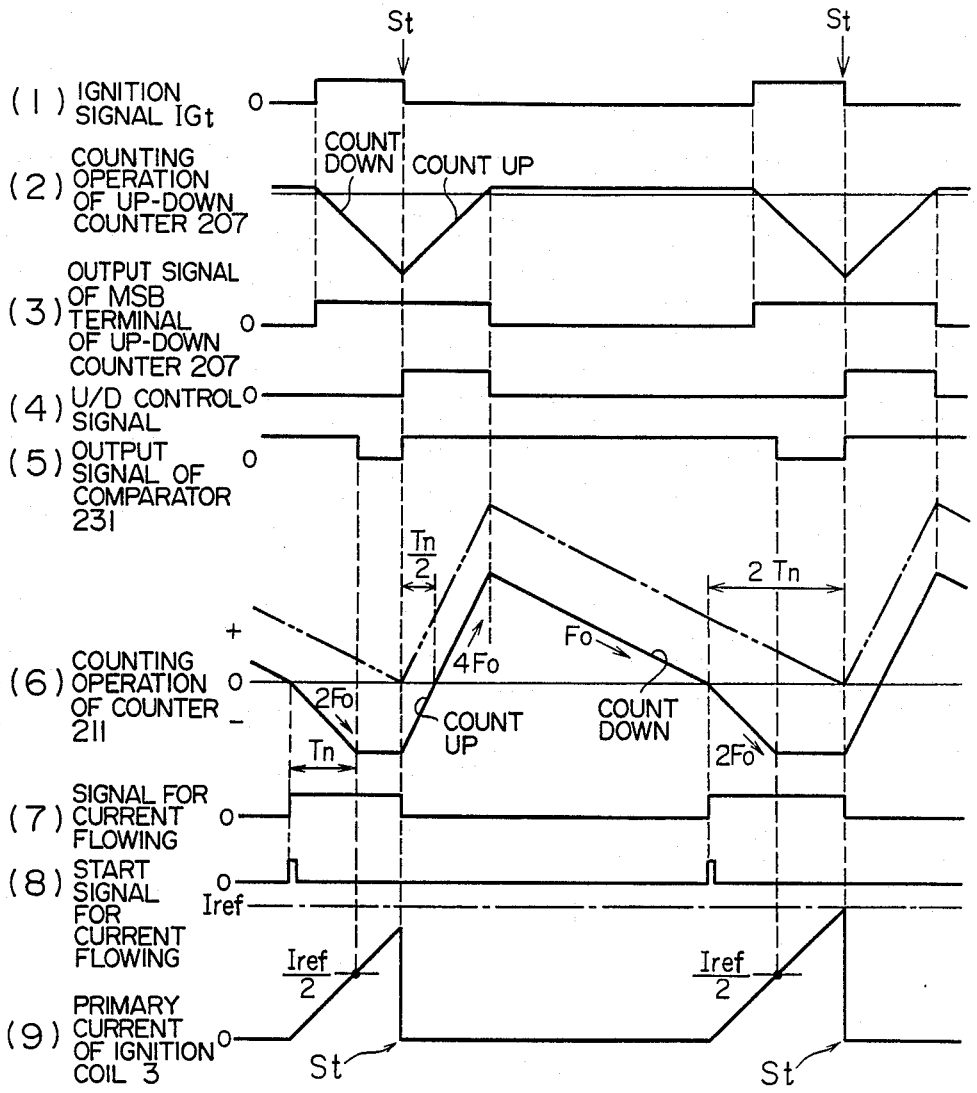
FIG. 3 shows waveforms at various parts for explaining the operation of the current flowing time period control system.

The ignition signal IGt shown in (1) of FIG. 3 produced from the CPU 1 of the engine-controlling computer has pulses whose pulse widths are equivalent to a predetermined crank angle, and the trailing edges of these pulses represent the ignition timing St. This ignition signal IGt is applied to the comparator 205 through a filter made up of the resistor 201 and the capacitor 202 in the ignitor 2. This comparator 205 shapes the ignition signal IGt into a waveform of inverted pulse, which branches out into two routes. In one route, the output signal of the comparator 205 is applied, through the inverter 206 where the signal is inverted again, to the U/D terminal of the up-down counter 207 as the ignition signal IGt. When the ignition signal IGt is at high level, the up-down counter 207 counts down, and when the signal IGt is at low level, counts up. Also, in another route, the output signal is applied to the D-type flip-flops 208 and 209 which cause the counter 207 to be reset in synchronism with the leading edges of pulses in the ignition signal IGt. As a result, the up-down counter 207 performs the counting operation in the manner shown in (2) of FIG. 3. An output signal shown in (3) of FIG. 3 is produced from the most significant bit (MSB) terminal of the counter 207. A logic sum between this output signal and the inverted ignition signal IGt is obtained in the output terminal of the AND circuit 210. The resulting signal, as shown in (4) of FIG. 3, has a pulse waveform similar to the supplied ignition signal IGt with the same pulse width and delayed by the pulse width. This signal will hereinafter be referred to as "the up-down control signal (U/D control signal)". The U/D control signal is applied to the U/D terminal of the up-down counter 211 through the inverter 217. The up-down counter 211 counts down when the U/D control signal is at low level, and counts up when it is at high level.

As a result, the up-down counter 211 counts up during the time period corresponding to a predetermined crank angle after each spark (after the trailing edge time St), and then counts down until the following ignition time. This up-down counter 211 has two functions. One is to measure the rise time period of the primary current of the ignition coil 3, and the other to set the current flowing time period in the ignition coil 3.

According to the present invention, the current flowing time period of the ignition coil 3 is measured as the rise time period of the ignition coil 3, that is, the time period required before the primary current value of the ignition coil 3 reaches 1/n (n larger than 1, and preferably an integer of 2 or more) of the target current value (Iref). For the ignition of the following cylinder, a current flowing time period which is n times longer than the measured time period is set thereby to effect an optimum current flowing time period control (dwell angle control) of the ignition coil 3. In the following explanation, the value of n is set to 2.

The up-down counter 211 thus counts down the rise time period of the primary current of the ignition coil 3 first of all. This is realized by applying clock signal to be counted to the up-down counter 211 during the time Tn before the current supplied to the coil 3 reaches a value ½ of the target interruption current value Iref. This count value is required to be doubled in the next ignition cycle, and therefore if the time is counted down with reference to a clock signal of a frequency 2Fo twice higher than the frequency Fo of the basic clock signal in advance, the double calculation is possible at the time of counting. This change-over between the clock signals is effected by a digital switch 216. The count value of the counter 211 with the current value reaching ½ of the target interruption current value Iref is stored until the next ignition cycle. Therefore, it is necessary to prohibit the input of the clock signal in the counter 211 and hold the count value of the counter 211 subsequently to the counting operation. The input of the clock signal is prohibited by the AND circuit 212 according to the output signal of the comparator 231 described later. In order to set the measured count value appropriately as ON time pulses in the next ignition cycle, it is necessary to switch between the clock signal frequency 4Fo for count up and the clock signal frequency Fo for count down of the up-down counter 211 in accordance with the ratio between the countup time and count-down time of the up-down counter 211 (the ratio between the high and low levels of the U/D control signal shown in (4) of FIG. 3. This switching operation is effected by the digital switch 215. In view of the fact that the ratio between high and low levels of the U/D control signal is 1 to 4 in this embodiment, the ratio between the two frequencies of the clock signals is set to 4 to 1. This up-down counter 211 is connected with flip-flops 213 and 214 at a reset terminal thereof so as to be reset and initialized at the time of starting the current flow of the ignition coil 3. This counting operation of the up-down counter 211 is illustrated in the timing chart by a solid line in (6) of FIG. 3. A count value twice the rise time Tn which is ½ of the target current flowing time period of the primary current is subjected to the double calculation by an up-down counting operation of the counter 211 in the next ignition cycle thereby to obtain a current flowing time 2Tn twice the rise time Tn (the time required to reach ½) of the preceding ignition cycle. Thus, energization signal is obtained through a NAND circuit 218 which is supplied with the signal from the most significant bit (MSB) of the up-down counter 211 and the inverted U/D control signal.

This energization signal, after being current-amplified through transistors 222, 223 and 224, is applied to a power transistor 226 thereby to drive the ignition coil 3. When the current flowing in the ignition coil 3 and the power transistor 226 flows through a current detection resistor 227, a voltage corresponding to the current is generated thereby. The current under this condition is shown in (9) of FIG. 3. The voltage generated in the current detection resistor 227 is compared with a half level of the target interruption current Iref in a comparator 231, and when the voltage is not more than the half level, a high-level signal is outputted from the comparator 231 as shown in (5) of FIG. 3. This output signal is applied to the above-mentioned AND circuit 212, so that the count value obtained in the up-down counter 211 is held until the next ignition cycle.

The above-mentioned control cycle is repeated for each ignition cycle thereby to effect feedback control of obtaining the optimum current flowing time period.

Figure 4:
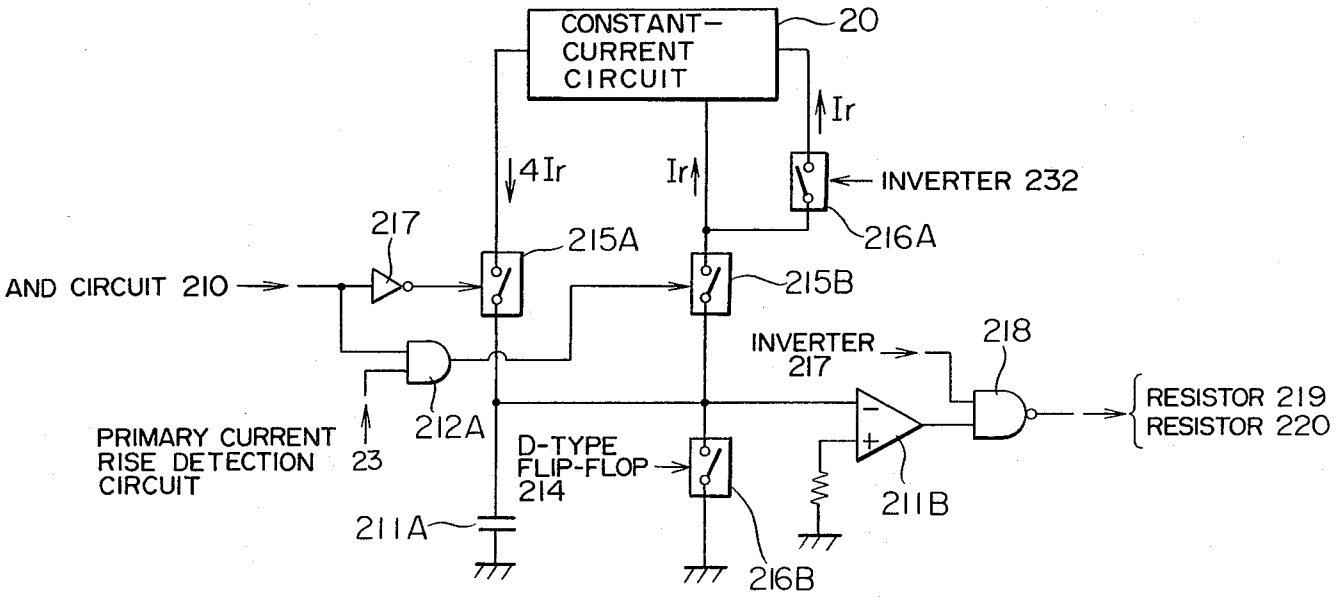
FIG. 4 is an electrical circuit diagram showing another embodiment of accumulation means of the system according to the present invention.

In the aforementioned embodiment, the up-down counter 211 is used as accumulation means for performing digital control. The same function is obtained analogically by use of a capacitor. An embodiment of such an alternative case is shown in FIG. 4, in which only those parts different from FIG. 1 are shown. Numeral 211A designates a capacitor making up accumulation means which is chargeable in both negative and positive directions. Numeral 20 designates a constant-current circuit for charging the capacitor 211A with predetermined currents −Ir, 4Ir, and −2Ir, and numeral 215A an analog switch turned on to charge the capacitor 211A in one direction of the two with the constant current 4Ir from the constant-current circuit 20 when the output signal of the inverter 217 is at high level. Numeral 212A designates an AND circuit for producing a logic product between the output signal of the AND circuit 210 and the output signal of the primary current rise detection circuit 23, and numeral 215B an analog switch turned on to charge the capacitor 211A in the other direction of the two with the constant current Ir flowing to the constant current circuit 20 when the output signal of the AND circuit 212A is at high level. Numeral 126A designates an analog switch turned on to charge the capacitor 211A in the other direction of the two with the current 2Ir produced by adding the constant current Ir to the constant current Ir to the constant current circuit 20 when the output signal of the inverter 232 is at high level. Numeral 216B designates an analog switch turned on to reset and initialize the charges of the capacitor 211A at the beginning of energization of the ignition coil 3 when the output signal of the D-type flip-flop 214 is at high level. Numeral 211B designates a comparator for producing a highlevel output when the charge voltage of the capacitor 211A drops below 0. The time of leading edge in the output signal pulse of this comparator 211B represents the start time of the primary current flow in the ignition coil 3. Therefore, the charge-discharge waveform of the capacitor 211A takes a form equivalent to the up-down count waveform of the up-down counter 211 shown in (6) of FIG. 3.

In each of the foregoing embodiments, the counting direction of the up-down counters 201 and 211 or the direction of charging the capacitor 211A may be reversed. Also, the initial value of the up-down counters 207 and 211 and the capacitor 211A is not limited to zero, but may of course be shifted to a desired value.

We claim:

1. A current flowing time period control system for an ignition coil of an internal combustion engine, comprising;

a power transistor for supplying and interrupting a primary current of the ignition coil, a circuit for detecting the rise of the primary current of the ignition coil to a value 1/n wherein n>1, of the desired interruption current value, a current flowing time period setting circuit including accumulation means in which the accumulated amount changes gradually at a first rate in one direction until the rise of the primary current of the ignition coil to 1/n of the desired interruption current value is detected, changes at a second rate in the other direction gradually at an ignition timing, and then changes in the original direction again at a third rate 1/n of the first rate, wherein the time period n times longer than the time period required for the rise of the primary current of the ignition coil to 1/n of the desired interruption current value is set as the primary current flowing time period for the next ignition cycle in accordance with the accumulated amount of the accumulation means, and a drive circuit for driving the power transistor in accordance with the primary current flowing time period set by said current flowing time period setting circuit.

2. A current flowing time period control system for an ignition coil an internal combustion engine according to claim 1, wherein said accumulation means is a first up-down counter.

3. A current flowing time period control system for an ignition coil of an internal combustion engine according to claim 2, wherein said current flowing time period setting circuit includes a comparator for inverting an ignition signal, a second up-down counter for performing the up and down counting operation in accordance with the ignition signal, an AND circuit for producing an up-down control signal on the basis of an inverted ignition signal produced from the comparator and the output signal of the second up-down counter and applying said up-down control signal to the accumulation first up-down counter, an oscillation circuit for producing a basic clock signal of a predetermined oscillation frequency, a frequency-dividing circuit for converting said clock signal into a second clock signal of a half frequency and a third clock signal of a one-fourth frequency, and change-over switch means for applying selected one of the basic clock signal, second clock signal and the third clock signal to the accumulation first up-down counter depending on conditions.

4. A current flowing time period control system for an ignition coil of an internal combustion engine according to claim 3, wherein said first up-down counter counts down until the primary current of the ignition coil reaches ½ of the interruption current on the basis of the second clock signal after starting the current flow, and holds the count value subsequently, and counts up while the up-down control signal is at count-up level in accordance with the basic clock signal after ignition, and counts down until the flowing of the primary current is started on the basis of the third clock signal subsequently.

5. A current flowing time period control system for an ignition coil of an internal combustion engine according to claim 1, wherein said accumulation means is a capacitor.

* * * * *